United States Patent [19]

Torita

[11] Patent Number: 4,742,698

[45] Date of Patent: May 10, 1988

[54] WASHER-DEHYDRATOR

[75] Inventor: Fumio Torita, Nagoya, Japan

[73] Assignee: Kabushiki Kaisha Toshiba, Kawasaki, Japan

[21] Appl. No.: 863,149

[22] Filed: May 14, 1986

[30] Foreign Application Priority Data

May 16, 1985 [JP] Japan ..... 60-104495
Jun. 18, 1985 [JP] Japan ..... 60-132762

[51] Int. Cl.[4] ..... D06F 23/04; D06F 33/02; D06F 37/24

[52] U.S. Cl. ..... 68/12 R; 68/23 R; 68/23.3

[58] Field of Search ..... 68/12 R, 23 R, 23.3; 494/7, 8, 9; 210/113, 360.1; 340/613; 361/178, 181; 307/118

[56] References Cited

FOREIGN PATENT DOCUMENTS 2300622 9/1976 France ..... 494/7
5345061 10/1976 Japan .
5370567 12/1976 Japan .
53-142053 5/1977 Japan .
147663 11/1979 Japan ..... 68/23.3

*Primary Examiner*—Philip R. Coe
*Attorney, Agent, or Firm*—Cushman, Darby & Cushman

[57] ABSTRACT

A washer-dehydrator comprising a casing, a rotating tub disposed in the casing and resiliently adapted to hold an object of dehydration therein, and a weight detector including a stationary electrode and movable electrode which delivers an output signal indicative of a change of electrostatic capacity corresponding to a change of the weight load of the rotating tub. The rotation of the tub is controlled in accordance with the output signal from the weight detector, thereby regulating the rotation of the rotating tub.

21 Claims, 3 Drawing Sheets

WASHER-DEHYDRATOR

BACKGROUND OF THE INVENTION

1. Field of Art

The present invention relates to a washer-dehydrator with a weight detector for automatically detecting the state or progress of dehydration in a rotating tub on the basis of the change of weight load of the tub during dehydration.

2. The Prior Art

In prior art dehydrators such as the dehydration mechanisms of dehydrators or dehydrators incorporated in dual-tub washing machines, a state detector is used to detect the progress of dehydration, e.g., the end of dehydration. Conventional detectors of this type include an optical sensor for detecting the presence of water drained off during dehydration or a pressure sensor for detecting the impulsive pressure of water splashed from a dehydrating tub during dehydration.

In the case of the optical sensor, the detection accuracy is lowered due to problems such as the soiling of an overflow and the change of the quantity of light from light emitting elements. Also, the measured value varies with the state of water flow, leading to false detection of the end of dehydration.

As for the pressure sensor, the probability of the pressure sensor getting hit by water is very low, thereby causing wrong end detection. Thus, in either case, the detection of the state of the dehydration process lacks reliability.

SUMMARY OF THE INVENTION

The object of the present invention is to provide a washer-dehydrator with a weight detector which reliably detects the state or progress of the dehydration.

According to the invention, there is provided a washer-dehydrator, which comprises a casing, a rotating tub disposed in the casing and is adapted to hold an object of dehydration therein, drive means for rotating the rotating tub, a weight detector delivering an output signal indicative of a change of electrostatic capacitance corresponding to a change of the weight load of the rotating tub, and control means for controlling the drive means in accordance with the output signal from the weight detector, thereby regulating the rotation of the rotating tub.

DETAILED DESCRIPTION OF THE PREFERRED EMBODIMENTS

A washer-dehydrator with a weight detector according to an embodiment of the present invention will now be described in detail with reference to the accompanying drawings.

Figure 1:
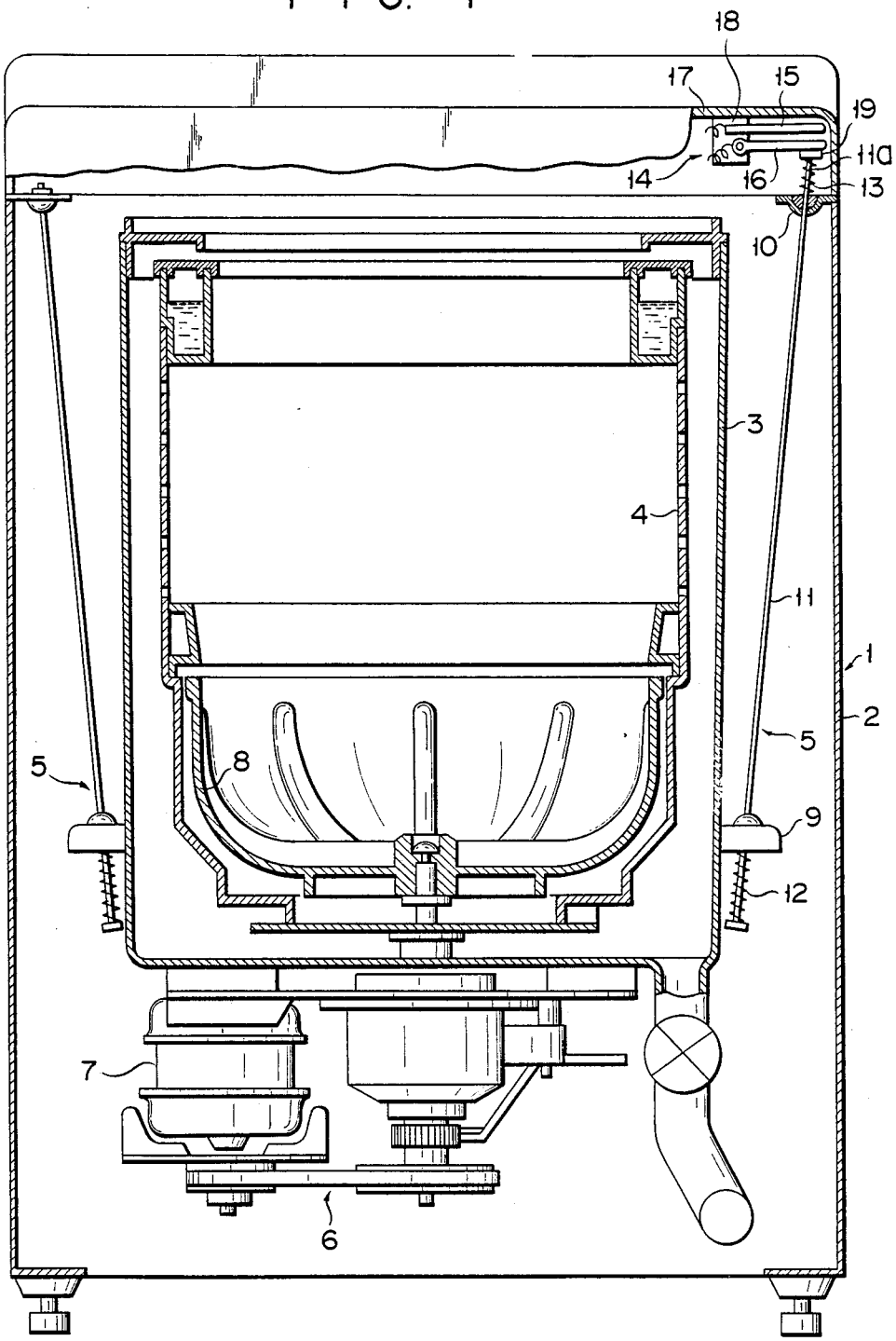
FIG. 1 is a sectional view of a washer-dehydrator according to an embodiment of the present invention.

In FIG. 1, numeral 1 designates a washer housing, which includes casing 2 and water reservoir 3 disposed inside the casing and having rotating tub 4 therein for washing and dehydration. Reservoir 3 is resiliently suspended from casing 2 by means of four suspension mechanisms 5 (described in detail later) so that it is kept apart from the inner bottom surface of the casing. Drive unit 6 is attached to the underside of reservoir 3. It includes motor 7 and a transmission mechanism for transmitting the driving force of the motor to tub 4 to rotate it. Disposed in tub 4 is vessel-shaped agitator 8 which is adapted to rotate together with the tub during dehydration and to rotate relatively to the tub during washing operation.

Each suspension mechanism 5 includes suspension rod 11 loosely passed through an aperture of supportable arm 9 which protrudes from each corresponding side wall of water reservoir 3. The upper part of each rod 11 is loosely passed through an aperture of its corresponding supporting portion 10 which protrudes from the inside of casing 2. A flange portion is formed on the lower end of rod 11. First coil spring 12 is interposed between the flange portion of rod 11 and arm 9 so as to surround the lower part of the rod. Flange portion 19, made of an insulator, is formed on the upper end of suspension rod 11. Second coil spring 13 is interposed between flange portion 19 and supporting portion 10, surrounding the upper part of rod 11. The suspension rods move up and down depending on the relationships between the urging forces of first and second springs 12 and 13 and the total weight of the supported structures and objects, including tub 4, reservoir 3, drive unit 6, and water and laundry in reservoir 3.

Figure 2:
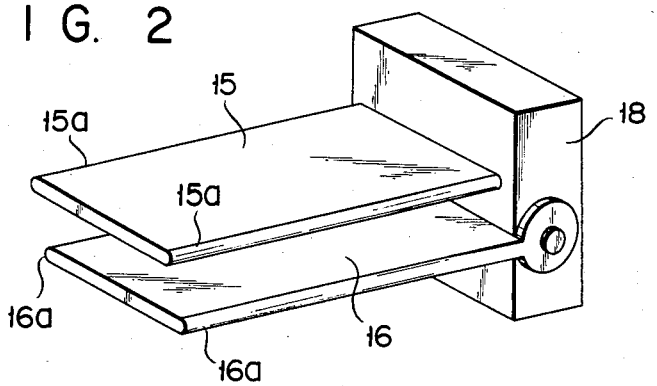
FIG. 2 is a perspective view showing a pair of electrodes of a weight detector of the washer-dehydrator of FIG. 1.

Weight detector 14 is provided near the upper end of suspension rod 11. It includes first and second electrodes 15 and 16 facing each other. One end of first electrode 15 is fixed to fixture 18 which is attached to a stationary part of washer housing 1 or upper cover 17 at the top of casing 2. The other end of electrode 15 extends above flange portion 19. One end of second electrode 16 is pivotally mounted on fixture 18 so that the two electrodes vertically face each other with a dielectric layer (air layer in this case) between them. The other end of electrode 16 engages the upper surface of flange portion 19. Thus, as rod 11 moves up or down, electrode 16 rocks around its one end through an angle corresponding to the displacement of the rod, thereby changing the electrostatic capacitance between the two electrodes. As shown in FIG. 2, electrodes 15 and 16 are each formed of a flat conductive metal plate. Both lateral faces 15*a* and 16*a* of electrodes 15 and 16 are chamfered semicircularly.

Figure 3:
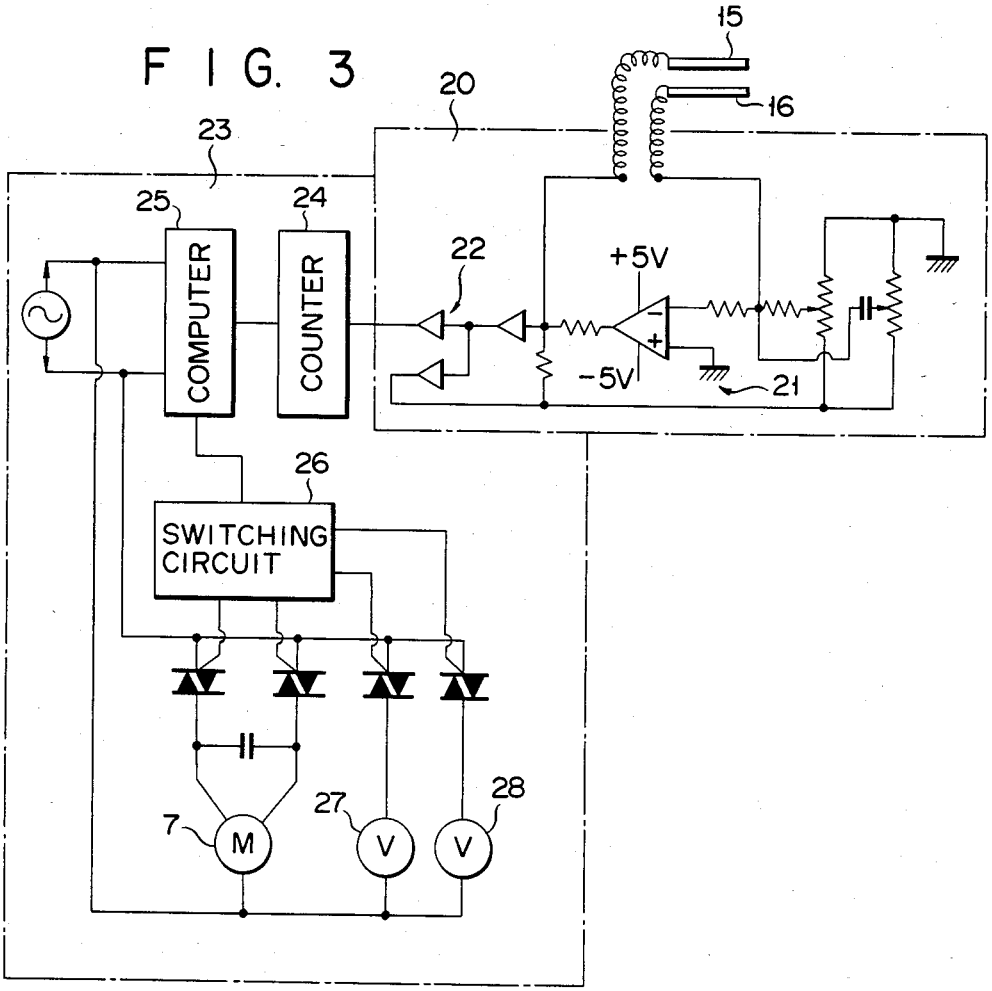
FIG. 3 is a diagram showing a detector circuit of the washer-dehydrator.

In FIG. 3, numeral 20 designates a signal output circuit which delivers a weight detection signal indicative of the accumulation of electricity or electrostatic capacity capacitance between first and second electrodes 15 and 16. Circuit 20 includes frequency generator circuit 21 for generating an oscillation frequency corresponding to the capacitance, and amplifier circuit 22 for amplifying the output of circuit 12. The output side of circuit 20 is connected to operation control circuit 23. Circuit 23 includes counter circuit 24 for counting pulses of the amplified frequency output for unit time, microcomputer 25 connected to the output side of circuit 24, and switching circuit 26 driven by a signal from the computer. Computer 25 is a conventional microcomputer which gives circuit 26 a switching instruction with a predetermined timing, based on reference data set in accordance with an input signal. In response to the instruction, switching circuit 26 controls the drive of motor 7 for rotating tub 4, the operation of inlet valve 27 attached to a feed water pipe (not shown) through which water is fed into tub 4, and the operation of sewer valve 28 attached to a drain pipe connected to water reservoir 3.

Electrostatic capacitance C between first and second electrodes 15 and 16 is given by $$C = C1 + C2 \quad (1)$$

where C1 is the capacitance between the facing regions of electrodes 15 and 16, and C2 is the sum of capacitances between the semicircular lateral faces of the electrodes. Capacitances C1 and C2 may be expressed as follows:

$$C1 = 1/d, \text{ and} \quad (2)$$

$$C2 = 1/\log (d-r)/r, \quad (3)$$

where d is the distance between electrodes 15 and 16, and r is the radius of curvature of the semicircular lateral faces of the electrodes.

Figure 4:
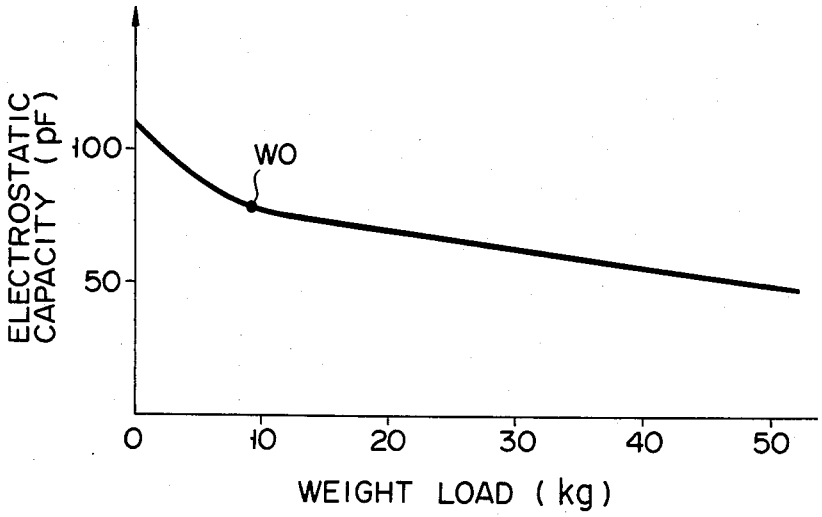
FIG. 4 shows a characteristic curve representing electrostatic capacitance varying with weight load.

Thus, electrostatic capacitance C varies with weight load as shown in FIG. 4. The characteristic curve of FIG. 4 indicates that the rate of change of the capacitance increases as the load decreases. The weight load fluctuates due to vibration and other causes during normal dehydrating operation. Therefore, the transition characteristic of capacitance for actual dehydration, as shown in FIG. 4, is obtained as the mean value calculated by integration or the like. Operation control circuit 23 calculates the rate of change in frequency which correlates to the rate of change of capacitance as weight detection signals are successively delivered from signal output circuit 20 and compared with the preceding count value. When the rate of change of capacitance reaches a predetermined high rate of change Q, circuit 23 delivers a dehydration state detection signal (dehydration end detection signal in this case), thus stopping the rotation of tub 4 by motor 7. In FIG. 4, rate Q corresponds to weight WO (approx. 9 kg) with which the rate of change of capacitance is high.

Figure 5:
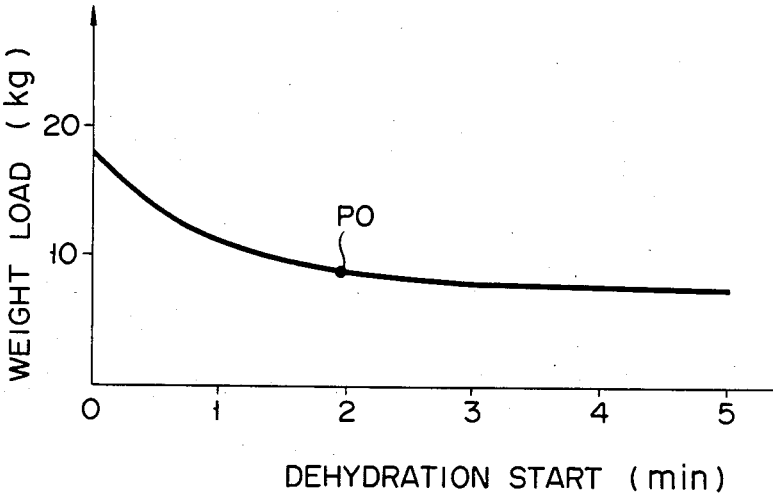
FIG. 5 shows a characteristic curve representing weight load varying with dehydration period.

FIG. 5 shows the normal transition characteristic of weight load varying with dehydration period. In the initial stage of dehydration, plenty of water is removed from the laundry being dehydrated, so that the rate of change of the load is high, as shown in FIG. 5. The rate of change of the load tends to lower with the lapse of time.

Thus, according to this embodiment, when the laundry or object of dehydration having a certain weight is dehydrated in rotating tub 4, the weight load decreases, while the electrostatic capacity increases in the manner shown in FIG. 4. When the rate of change of capacitance reaches predetermined rate Q (corresponding to weight WO in FIG. 3 and time PO in FIG. 5), the rotation of tub 4 is stopped. Thus, the dehydrating operation ends.

Arranged in this manner, the present embodiment provides the following effects or functions.

The state or progress of dehydration is detected on the basis of the rate of change of electrostatic capacitance, which varies with the weight load. Thus, the optical sensor for detecting the presence of drainage can be omitted, so that the detection cannot be affected by soiling of an overflow or, change of the quantity of light from light emitting elements. Since the pressure sensor for detecting the impulsive pressure of water can also be omitted, the detection cannot be influenced by the position of the pressure sensor. In consequence, according to the invention, the causes of false detection can be removed, greatly improving the reliability of the detection of the progress of dehydration.

In the washer-dehydrator according to the embodiment described above, the lateral faces of the electrodes of the weight detector are semicircular in shape so that the rate of change of electrostatic capacitance varies with weight load. Alternatively, however, they may be flattened so that the rate of change of capacitance should not vary with load, but rather that the capacitance changes rectilinearly with load. In this case, since the dehydration ends while the rate of change of the weight load is low, the detection should preferably be effected when the rate of change of the load is relatively low, e.g., near time point PO on the characteristic curve of FIG. 5.

However, because the weight load fluctuates in an actual dehydrating operation, the wrong operation may sometimes be caused due to the false detection of a low-rate of change region, even though the mean value of load is calculated by integration. Therefore, in the apparatus according to the above embodiment, the end or progress of dehydration is detected by means of the weight detector of a capacitance-conversion type which is designed so that the rate of change of capacitance is high when that of weight load is low. Thus, the detection enjoys high accuracy despite the fluctuation of weight load.

In the embodiment described above, moreover, the electrostatic capacity between electrodes 15 and 16 is changed by shifting the position of suspension rod 11 of each suspension mechanism 5. However, the means for changing the capacitance may be any other suitable member which can shift its position as the weight load of rotating tub 4, as a dehydrating tub, varies. For example, the capacitance between electrodes 15 and 16 may alternatively be changed by shifting the position of supportable arm 9. Instead of being flat in shape, the opposite surfaces of electrodes 15 and 16 may be made convex so that the change of capacitance, as expressed by eq. (3), is great.

It is to be understood that the present invention is not limited to the embodiment described above, and that various changes and modifications may be effected therein by one skilled in the art without departing from the scope or spirit of the invention.

As described in detail herein, the washer-dehydrator according to the invention is provided with a weight detector which detects the weight load acting on a dehydrating tub by converting it into electrostatic capacitance. The state or progress of dehydration is detected in accordance with the rate of change of capacitance in the weight detector. Thus, in detecting the progress of dehydration, the causes of errors can be removed, and the detection accuracy can be improved. In consequence, the reliability of the apparatus can be improved greatly.

What is claimed is:

1. A washer-dehydrator comprising:

a casing;

a rotating tub disposed in said casing and adapted to hold an object of dehydration therein;

supporting means for movably supporting said rotating tub against said casing and allowing for vertical movement of said rotating tub;

drive means for rotating said rotating tub;

a weight detector delivering an output signal indicative of a change of electrostatic capacitance corresponding to a change in a weight load of said rotating tub, said weight detector including:

a fixed electrode fixed to said casing, a movable electrode facing said fixed electrode so that said movable electrode's movement corresponds to said vertical movement of said rotating tub to cause a change in said electrostatic capacitance between said electrodes, and control means for controlling said drive means in accordance with said output signal from said weight detector to regulate the rotation of said rotating tub.

2. The washer-dehydrator according to claim 1, wherein said output signal from said weight detector is indicative of a rate of change of electrostatic capacitance which corresponds to a change of said weight load of said rotating tub.

3. The washer-dehydrator according to claim 2, wherein said rate of change of electrostatic capacitance of said weight detector lowers as said weight load of said rotating tub increases.

4. The washer-dehydrator according to claim 3, wherein said weight detector includes a movable electrode adapted to move in accordance with said change of said weight load of said rotating tub and a fixed electrode facing said movable electrode so that said rate of change of said electrostatic capacitance between said two electrodes varies as said movable electrode moves.

5. The washer-dehydrator according to claim 4, wherein said fixed electrode is fixed to said casing and said movable electrode is rockably supported on said casing and which further includes means for rocking said movable electrode in accordance with said change of said movable electrode in accordance with said change of said weight load of said rotating tub.

6. The washer-dehydrator according to claim 5, wherein at least one of said two electrodes has a flat opposite face and lateral faces with a predetermined curvature.

7. The washer-dehydrator according to claim 6, wherein each of said electrodes has a flat opposite face and lateral faces with said predetermined curvature.

8. The washer-dehydrator according to claim 7, wherein each of said electrodes has two substantially semicircular lateral faces.

9. A washer-dehydrator according to claim 1 wherein said movable electrode is moved towards said fixed electrode as said weight load of said rotating tub decreases.

10. A washer-dehydrator according to claim 9, wherein said fixed electrode is mounted on said casing above said rotating tub so that said movable electrode moves upward, closer to said fixed electrode as said weight load of said rotating tub decreases.

11. A washer-dehydrator comprising:

a casing;

a rotating tub disposed in said casing and adapted to hold an object of dehydration therein, said rotating tub having a plurality of holes from which water in said rotating tub is discharged outside of said rotating tub;

drive means for rotating said rotating tub;

a weight detector delivering an output signal indicative of a rate of change of electrostatic capacitance corresponding to a change in a weight load of said rotating tub; and control means for controlling said drive means in accordance with said output signal from said weight detector to regulate the rotation of said rotating tub.

12. The washer-dehydrator according to claim 11, further comprising supporting means for resiliently supporting the rotating tub on the casing.

13. The washer-dehydrator according to claim 12, wherein said supporting means includes a water reservoir containing therein the rotating tub for rotation and fitted with the drive means, and suspension means for resiliently suspending the water reservoir from the casing.

14. The washer-dehydrator according to claim 13, wherein said suspension means includes a plurality of suspension mechanisms each having a suspension rod, one end side of which is supported on the water reservoir for movement relative thereto and the other end side of which is supported on the casing for movement relative thereto, and urging means for resiliently supporting the reservoir on the rod, said suspension rod shifting its position relative to the casing in accordance with the weight load of the rotating tub.

15. The washer-dehydrator according to claim 14, wherein said weight detector includes a fixed electrode fixed to the casing and a movable electrode facing the fixed electrode so as to be movable with the suspension rod.

16. A washer-dehydrator comprising:

a casing;

a rotating tub disposed in said casing and adapted to hold an object of dehydration therein and having a weight load;

drive means for rotating said rotating tub;

means for resiliently supporting said rotating tub on said casing, said supporting means including:

a water reservoir containing therein said rotating tub, suspension means for resiliently suspending said water reservoir from said casing, said suspension means including a plurality of suspension mechanisms, each of said suspension mechanisms including a suspension rod, one end side of which is supported on said water reservoir and the other end supported on said casing for resiliently supporting said reservoir on said suspension rod so that said suspension rod shifts its position relative to said casing in accordance with said weight load of said rotating tub;

a weight detector delivering an output signal indicative of a change of electrostatic capacitance corresponding to a change of said weight load, said weight detector including:

a fixed electrode fixed to said casing, a movable electrode facing said fixed electrode and movable with said suspension rod;

control means for controlling said drive means in accordance with said output signal from said weight detector to regulate the rotation of said rotating tub.

17. A washer-dehydrator according to claim 16, wherein said movable electrode is moved towards said fixed electrode as said weight load of said rotating tub decreases.

18. A washer-dehydrator according to claim 17, wherein said fixed electrode is mounted on said casing above said rotating tub so that said movable electrode moves upward, closer to said fixed electrode as said weight load of said rotating tub decreases.

19. The washer-dehydrator according to claim 16, wherein at least one of said two electrodes has a flat opposite face and lateral faces with a predetermined curvature.

20. The washer-dehydrator according to claim 19, wherein each of said electrodes has a flat opposite face and lateral faces with said predetermined curvature.

21. The washer-dehydrator according to claim 20, wherein each of said electrodes has two substantially semicircular lateral faces.

* * * * *